United States Patent [19]

Maclin

[11] Patent Number: 4,480,436

[45] Date of Patent: Nov. 6, 1984

[54] COMBUSTION CHAMBER CONSTRUCTION

[75] Inventor: Harvey M. Maclin, Cincinnati, Ohio

[73] Assignee: General Electric Company, Cincinnati, Ohio

[21] Appl. No.: 316,531

[22] Filed: Dec. 19, 1972

[51] Int. Cl.[3] ..... F02C 7/20

[52] U.S. Cl. ..... 60/39.32; 60/757; 60/752

[58] Field of Search ..... 60/39.32, 39.65, 39.69, 60/253, 255, 257, 260, 261, 200 A; 110/1 A; 138/147–149, 151, 155, 162, 166; 415/115, 139, 108; 75/206

[56] References Cited

U.S. PATENT DOCUMENTS

| | | | |
|---|---|---|---|
| 2,268,464 | 12/1941 | Seippel | 60/39.65 |
| 2,544,538 | 3/1951 | Mahnken et al. | 60/39.32 |
| 2,553,393 | 5/1951 | Weber | 110/1 A |
| 2,617,255 | 11/1952 | Niehus | 60/39.65 |
| 2,859,934 | 11/1958 | Halford et al. | 415/115 |
| 2,919,549 | 1/1960 | Haworth et al. | 60/39.65 |
| 3,159,944 | 12/1964 | Deming | 110/1 A |
| 3,349,558 | 10/1967 | Smith | 60/39.65 |
| 3,542,483 | 11/1970 | Gagliardi | 415/139 |
| 3,595,710 | 7/1971 | Lambert et al. | 75/206 |
| 3,716,357 | 2/1973 | Evans et al. | 75/206 |

OTHER PUBLICATIONS

Porter, H. B., *Rocket Refractories,* Navord Report 4893, Nots 1191, China Lake, Calif., 1955, pp. 9,10, 16–18, 34,35.

*Primary Examiner*—Harold J. Tudon
*Assistant Examiner*—David K. Cornwell
*Attorney, Agent, or Firm*—Henry J. Policinski; Derek P. Lawrence

[57] ABSTRACT

A combustion chamber for use in gas turbine engines is provided with a liner formed of a high temperature material. The liner includes a plurality of panels of the material mounted by means of a lost motion mounting arrangement upon a high strength structural frame. As a result of this mounting arrangement, the liner is substantially isolated from structural forces associated with the combustion chamber, while the frame is substantially isolated from thermal stresses associated with the liner. For the purpose of supplying cooling air to the liner panels and frame and cooling air is passed into a plenum to cool the radially outward side of the panels. Transfer means are provided for directing the same air from the plenum to the liner inner surfaces in a cooling film. The liner mounting arrangement disclosed herein is particularly useful with difficult-to-weld liner materials (e.g., oxide dispersion strengthened materials), but its advantages commend its use with other materials also.

2 Claims, 8 Drawing Figures

Fig 1
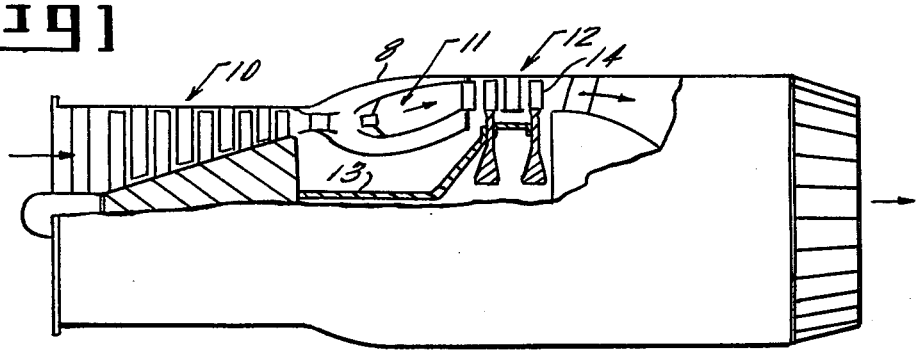
Fig 3
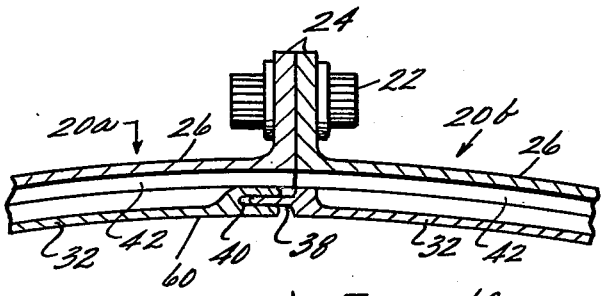
Fig 5
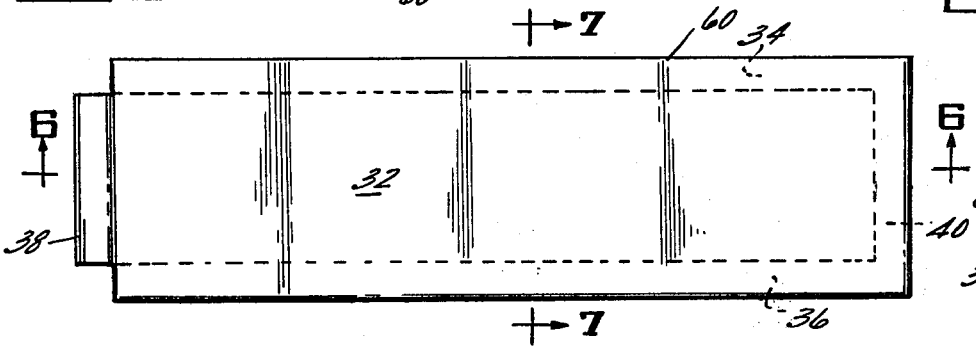
Fig 7
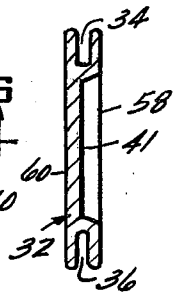
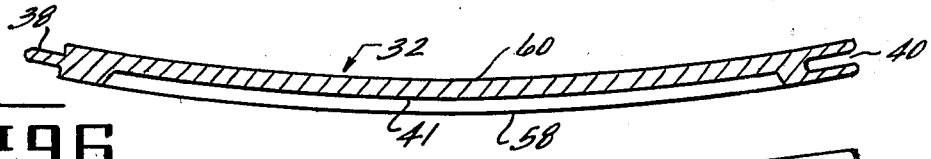
Fig 6
Fig 8
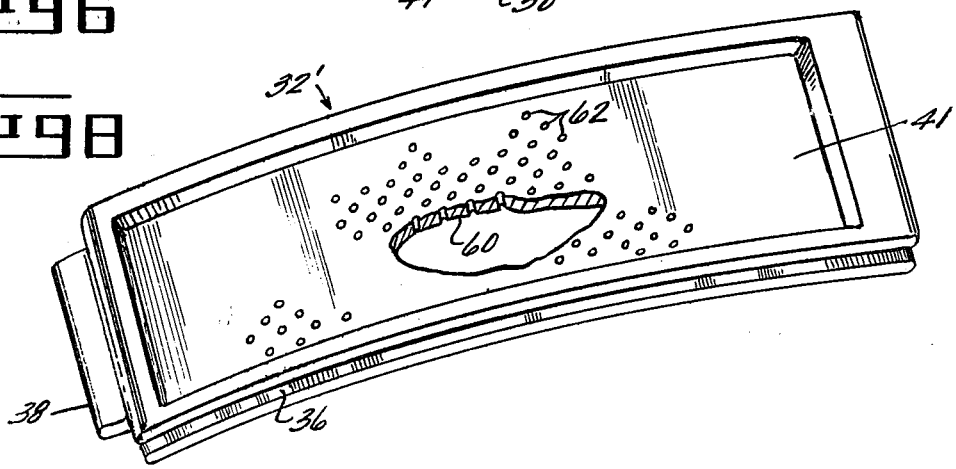

COMBUSTION CHAMBER CONSTRUCTION

This invention relates to gas turbine engines, and more particularly, to combustion chambers for use therein. The invention herein described was made in the course of or under a contract, or a subcontract thereunder, with the U.S. Department of the Air Force.

Related to this application are co-pending and concurrently filed cases, Ser. No. 316,441, Ser. No. 316,530 and Ser. No. 316,532 all filed Dec. 19, 1972 and assigned to the same assignee as the present application.

BACKGROUND OF THE INVENTION

Gas turbine engine efficiency is a function of various parameters, among them the temperatures achievable within combustion chambes as well as the amount of air which must be diverted to cool various elements of the engine. Additionally, the structural integrity of an engine is improved if structural loads are carried by elements of the engine which elements are not also subjected to high temperatures and attendant thermal stresses.

In an attempt to raise achievable temperatures within combustion chambers, various metals and alloys have been used in the construction of the chambers. Two such materials which exhibit particularly beneficial heat resistance are oxide dispersion strengthened metals such as thoria dispersed nickel and thoria dispersed nickel chromium alloy, which have melting temperatures of approximately 2500° to 2600° F., and which exhibit high strength characteristics up to temperatures of 2200° F. Thus, these materials would prove useful in the construction of combustion chambers. A major drawback of these and certain other high temperature metallic materials, however, is that they are difficult or impractical to weld. In the case of the thoria dispersed materials, the weld area loses thoria, consequently reducing substantially the strength of the material. The present invention provides a construction arrangement for use in gas turbine engines whereby such materials (and other appropriate materials, e.g. FeCrAl, columbium, etc.) can be effectively applied as liners for combustion chambers without the necessity of welding.

The effective application of such higher temperature operating materials as thoria dispersed nickel or thoria dispersed nickel chromium alloy as a liner within combustion chambers, in addition to enabling higher temperatures to be reached, also allows a reduction in the amount of cooling air required to be directed to the liner during operation. This reduction enables the engine to operate with increased efficiency. The present invention further provides means for effectively utilizing the reduced quantity of cooling air to cool both the inner and outer sides of the combustion chamber liner.

Structural failures in gas turbine engines in the past have often resulted from the subjection of structural load bearing portions of the engine to thermal stresses associated with the high temperatures of combustion. The formation of a combustion chamber in a way that requires the chamber liner (which is directly exposed to the heat of combustion) to carry structural loads associated with the combustion chamber has resulted in such failures. The present invention overcomes these problems by isolating the liner of the combustion chamber from the structural loads associated with the frame encircling the chamber.

SUMMARY OF THE INVENTION

It is therefore a primary object of the present invention to provide a combustion chamber for use in gas turbine engines which provides improved structural integrity by providing independent elements for subjection respectively to thermal and structural stresses associated with a combustion chamber.

It is another object of the present invention to provide a combustion chamber for use in gas turbine engines wherein an improved liner formed of difficult-to-weld high temperature materials can be utilized without the disadvantages inherent in welding these materials.

It is a further object of this invention to provide a combustion chamber construction in which individual elements are easily accessible for the purpose of replacement.

It is a further object of the present invention to provide a combustion chamber for use in gas turbine engines having improved means for passing a quantity of cooling air over the chamber liner in a manner which accomplishes improved utilization thereof.

These objects, and others which will become apparent from the detailed description hereinafter, are accomplished by the present invention, in one form thereof, by means of the use of thoria dispersed nickel or thoria dispersed nickel chromium alloy to form a combustion chamber liner including a plurality of panels mounted by means of a slideable tongue and groove junction upon a plurality of pairs of spaced flanges carried by a high strength structural frame. A plenum is defined between the liner panels and frame, and means for passing cooling air from the plenum over the liner panels is provided.

The present invention is more particularly described in conjunction with the following drawings, wherein:

FIG. 1 is a simplified cross-sectional view of a gas turbine engine;

FIG. 3 is a view of a portion of the combustion chamber of FIG. 2 taken along line 3—3 of FIG. 2;

FIG. 5 is a depiction of an individual liner panel according to the present invention;

FIG. 6 is a section view of the panel of FIG. 5 taken along line 6—6;

FIG. 7 is a section view of the panel of FIG. 5 taken along line 7—7; and FIG. 8 is a perspective view of a modified form of a liner panel according to the present invention shown partly in section.

DESCRIPTION OF A PREFERRED EMBODIMENT

Figures 2, 4:
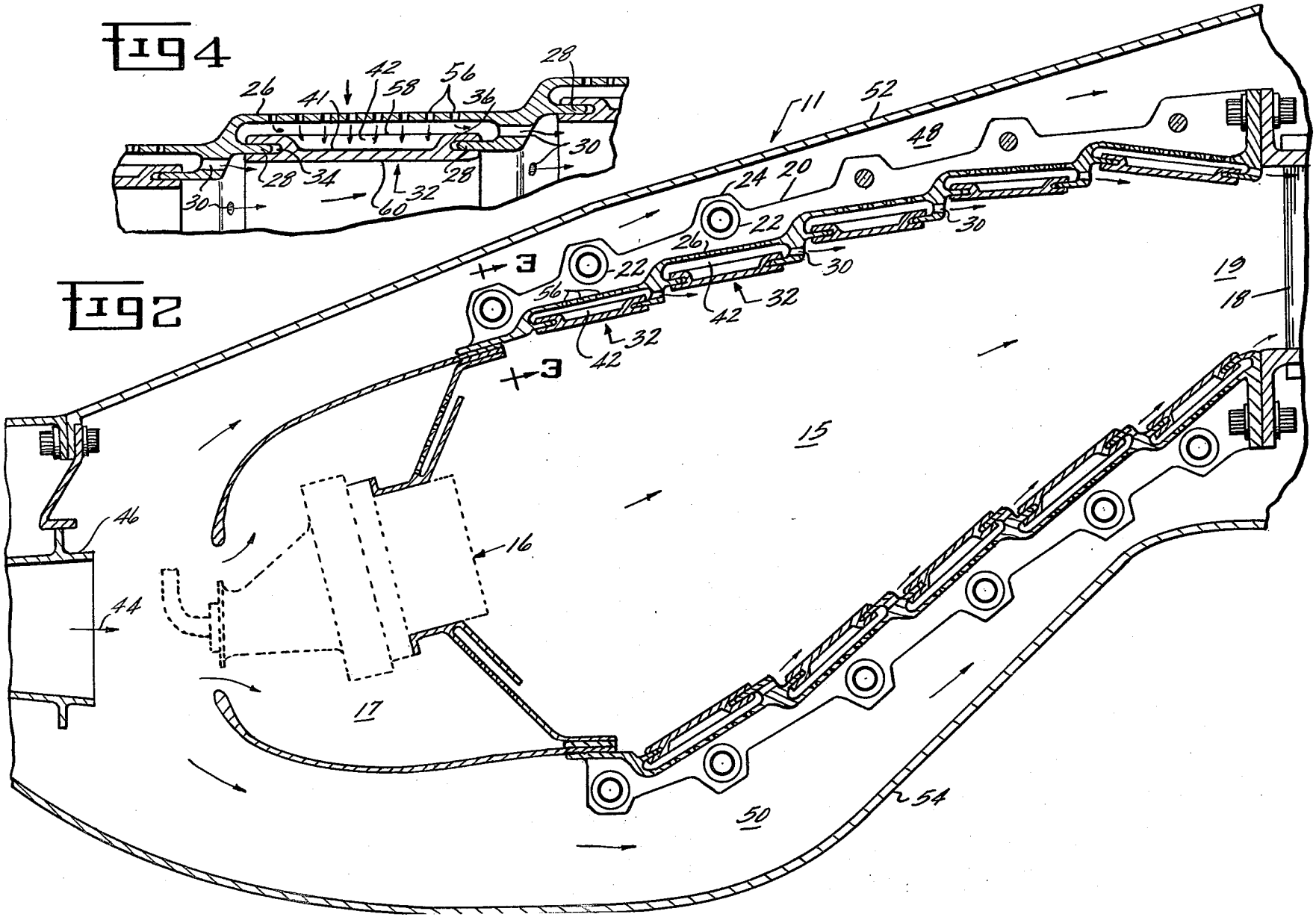
FIG. 2 is a cross-sectional view of a combustion chamber according to the present invention.
FIG. 4 is an enlarged fragmentary view of a portion of the combustion chamber of FIG. 2.

The gas turbine engine depicted in FIG. 1 includes the basic elements of typical turbomachinery of this variety. A substantially cylindrical housing 8 surrounds a compressor 10, combustion chamber 11, and a turbine 12, all disposed about a rotatable shaft 13. As is well known in the art, atmospheric air enters the engine from the left to be pressurized, heated, and expelled to the right to provide usable thrust. More particularly, air enters from the left and is operated upon by the compressor 10 to be pressurized and directed in part into combustion chamber 11. Heat energy is added to the air within the combustion chamber by the burning of appropriate fuel supplied thereto. Working fluid, which is the combination of air and burned fuel, exits at the right end of the combustion chamber 11 and engages a plurality of turbine blades 14 carried by a number of adjacent discs making up turbine 12. The engagement of the turbine blades by the working fluid serves to drive the turbine in rotation, which rotation is imparted to shaft 13. The rotation of shaft 13 initiates and powers the operation of compressor 10 at the forward end of the machine.

The operating temperature within combustion chambers presently reaches 2000° F., and in future designs will increase. For this reason, the combustion chamber must be capable of withstanding extremely high temperatures while maintaining its structural integrity. Furthermore, the quantity of cooling air provided for cooling the combustion chamber must be limited in order to achieve high engine efficiency.

Referring to FIGS. 2, 3, and 4, the combustion chamber 11 defines a combustion zone 15 and includes a fuel nozzle 16 disposed within an upstream air/fuel inlet 17. A turbine nozzle stage 18 is disposed within a downstream outlet 19 for expelling of the products of combustion. The combustion chamber also includes a high strength structural frame 20 divided into axial sections **20*a* and 20*b*, which sections are releasably held together by means of a plurality of bolts 22 projecting through pairs of abutting axial protrusions 24 spaced about the circumference of frame 20. The frame also includes a backing piece 26 which carries a plurality of pairs of opposed spaced flanges 28. In addition, the backing piece 26 includes a plurality of apertures 30 extending axially thereof between adjacent flanges 28** for the purpose of directing film cooling air over the inner surfaces of the combustion chamber.

For the purpose of withstanding the extreme temperatures of combustion required for efficient gas turbine engine operation, a heat resistant liner is provided by the present invention. According to the present invention, the liner takes the form of a plurality of panels 32 mounted upon structural frame 20 and substantially circumscribing the combustion zone 15 of the combustion chamber 11 for the purpose of forming a barrier against the heat of combustion therein. Panels 32 are formed, in one embodiment, alternatively of thoria dispersed nickel or thoria dispersed nickel chromium alloy. Each of these materials has been found extremely heat resistant with a melting temperature of 2500° to 2600° F., and able to exhibit high strength characteristics up to temperatures of 2200° F. A particular problem with respect to these materials which has substantially prevented their use in combustion chambers of the prior art is the inability of these materials to maintain their desirable properties after being welded. Fabrication of such materials into viable combustion chambers is accomplished by means of the present invention.

While these thoria dispersed nickel materials exhibit qualities which make them particularly suitable for use in the configuration of the present invention, it is contemplated that future materials advances will result in improved compositions for such use. Other oxide dispersion strengthened metallic and even non-metallic refractory materials are beneficially usable with the fabrication arrangement of the present invention, owing to characteristics of reliable and easy fabrication and repair which will become apparent hereinafter. Hence, the mounting arrangement of the present invention commends itself to utilization with or without the particular materials cited herein.

More particularly, the present invention provides an improved mounting technique whereby individual liner panels of heat resistant material can be attached to a structural frame without welding. The cooperation between individual liner panels and the frame is accomplished by means of a lost-motion mounting technique such that dimensional distortion of either liner or frame is not transmitted to the other. Thus, the liner is effectively isolated from the structural loads associated with the frame; and the frame is effectively isolated from thermal stresses associated with the liner.

To further illustrate this concept, an individual liner panel 32 is depicted in FIGS. 5 through 7. The panel has a pair of longitudinal grooves 34 and 36 disposed upon opposite edges. In addition, a tongue projection 38 and another groove 40 occupy the third and fourth edges of the panel. For purposes of weight reduction and cooling, each panel also has a depression 41 in its back side. Grooves 34 and 36 are positioned and sized to fit slideably and loosely upon a pair of opposed flanges 28 of frame 20 (see FIG. 4). In this manner, a loose tongue and groove cooperation is established between the frame 20 and the plurality of panels 32. Furthermore, tongue 38 and groove 40 of the individual panels are positioned and sized to cooperate with like elements of adjacent panels (see FIG. 3) for the purpose of establishing a loose tongue and groove cooperation between abutting panels mounted upon the same pair of flanges 28.

According to one object of the present invention, grooves 34 and 36 of panel 32 are dimensioned to cooperate loosely with frame flanges 28 for the purpose of permitting distortion of either frame or panel without transmitting attendant stress to the other. Thus, as the frame 20 deflects under the structural loads associated with engine operation, flanges 28 are free to slide within grooves 34 and 36 without stressing panel 32. At the same time, panel 32 is free to expand and contract under thermal influence of the combustion zone 15 without stressing the frame. As a result, both the frame and liner panels are effectively isolated from one another, and substantially improved structural integrity is achieved.

Utilizing this mounting system the liner panels may be placed in proper position by sliding individual panels onto each pair of opposed flanges 28 and successively adding panels to this pair of flanges bringing adjacent panels into abutment with one another and their respective tongues and grooves into engagement. In this fashion, a plurality of panels 32 may be mounted upon an individual pair of opposed flanges 28 to substantially circumscribe the internal circumferential length of the combustion chamber portion defined by that particular frame section. Thereupon, mating frame sections carrying liner panels may be brought together and held in place by means of bolts 22 or other releasable fastening devices. The fabrication of the combustion chamber according to the present invention may be accomplished by fastening together a number of frame sections carrying liner panels 32, and by this means constructing a combustion chamber having a substantially circumscribing thoria dispersed nickel or thoria dispersed nickel chromium alloy liner without the requirement for welding the material. These qualities hold true for any panel material, and hence the beneficial characteristics of the present invention are readily adaptable for use with other panel materials.

According to another object of the present invention, the foregoing construction arrangement enables easy access to the individual liner panels for the purpose of replacement. In order to replace a panel, it is necessary to reverse the foregoing procedure - that is, the pertinent frame section is unbolted from its mates, removed, and the liner panels slid from their flanges. Thereupon, replacement panels may be slid in the place of those removed, and the frame bolted back together. Thus, the combustion chamber of the present invention represents a substantial advance over prior difficult-to-repair chambers.

It is well known in the art of gas turbine engine design that the amount of air diverted to various elements to cool them reduces the overall operational efficiency of the engine. According to another object of the present invention, the present invention provides a combustion chamber which operates satisfactorily with substantially reduced expenditure of cooling air, and therefore benefits overall engine efficiency. This result of reduced cooling air requirement is achieved by the utilization of such materials as thoria dispersed nickel or thoria dispersed nickel chromium alloys which, as stated, are capable of withstanding high operating temperatures.

The present invention further provides means for distributing cooling air in reduced amounts over the radially inner and outer sides of the individual panels 32 for improved utilization of a given quantity of cooling air. Between each panel 32 with its associated depression 41 and an adjacent portion of the encircling backing piece 26 is defined a plenum 42 (see FIGS. 3 and 4) to which a supply of high pressure cooling air 44 is directed from a compressor outlet 46 through annular spaces 48, 50 defined between frame 20 and casing members 52, 54. Each plenum 42 is arranged so that the cooling air entering the plenum through a plurality of openings 56 in backing piece 26 cools the outward side 58 of the associated panel 32. The air is then transferred from the plenum and directed in a cooling film by means of apertures 30 in the backing piece 26 of frame 20 over the inner side 60 of the panel (the side remote from plenum 42) immediately downstream of apertures 30. In this fashion, the quantity of cooling air fed to the plenum 42 serves to cool both sides of the panels comprising the liner.

An additional or alternative means for transferring cooling air from plenum 42 over the inner panel surfaces is depicted in FIG. 8.In this figure, a modified individual liner panel 32' is shown to include a plurality of spaced apertures 62. In operation, these apertures 62 provide communication between the inner surface 60 of a panel 32' and its associated plenum 42, whereby cooling air retained within the plenum may be transferred to the inner surface 60 of that panel. These apertures 62 may provide the necessary communication between the plena and inner panel surfaces in addition to or instead of the apertures 30 associated with backing piece 26 described above. Either embodiment represents a valuable improved utilization of a given quantity of cooling air to cool both sides of liner panels 32.

Operation of a gas turbine engine incorporating a combustion chamber according to the present invention exhibits numerous advantages over the prior art. In one embodiment, the use of thoria dispersed nickel or thoria dispersed nickel chromium alloy allows higher and more efficient operating temperatures, and accomplishes this without the expenditure of large quantities of cooling air. Furthermore, the cooling configuration disclosed herein provides that the reduced quantity of cooling air (made sufficient by this configuration) will achieve more complete utilization of its cooling capacity by being applied serially to the outer side of individual liner panels and then to the inner side of the panels. Furthermore, the liner panel mounting arrangement disclosed herein enables structural strength and thermal resistance to be optimized independently without negatively affecting one another.

It is apparent that those skilled in the art might make structural variations of the embodiments disclosed herein without departing from the spirit of the invention. For example, improved high temperature materials of various metallic or non-metallic composition not otherwise capable of being used within combustion chambers for lack of means of fabrication might be utilized by means of the mounting configuration of the present invention. Furthermore, lost motion mounting techniques equivalent to the tongue and groove embodiment disclosed herein may perform equivalent functions and thus fall within the spirit of the present invention. Such variations, as well as other equivalents, are intended to be covered within the scope of the appended claims.

What is claimed as new and desired to be secured by Letters Patent of the United States is:

1. A combustion chamber for use in gas turbine engines, the chamber comprising:

an inlet for receiving air and fuel to be burned;

an outlet for expelling products of combustion;

high strength structural frame means disposed between the inlet and the outlet for supporting mechanical forces associated with the chamber; and liner means disposed within the frame, said liner means including a plurality of circumferentially adjacent panels of high temperature material, at least one of said panels having grooves in two axially facing opposed edges and further having a pair of circumferentially facing edges, said frame means including a plurality of pairs of spaced, opposed flanges, each flange of at least one of said pairs of flanges including a tongue protrusion for cooperation with one of said grooves to slideably retain said panels between said pair of flanges, said pair of circumferentially facing edges on said one of said panels cooperating in a tongue and groove relationship with circumferentially facing edges on other of said circumferentially adjacent panels.

2. A combustion chamber for use in gas turbine engines, the chamber including:

an inlet for receiving air and fuel to be burned;

an outlet for expelling products of combustion;

a liner disposed between the inlet and comprising a plurality of cooperating panels disposed circumferentially adjacent one another, said panels including a pair of axially facing edges and a pair of circumferentially facing edges; and a high strength structural frame circumscribing said liner and including a plurality of circumferentially extending, axially spaced flanges, said flanges and said axially facing edges cooperating in a first tongue and groove relationship to mount said panels on said flanges in a lost motion relationship therewith, said first tongues and grooves being dimensioned to permit relative sliding movement between said panels and said frame whereby said panels and said frame are each respectfully substantially isolated from the effects of dimensional distortions of the other, said pair of circumferentially facing edges on at least one of said panels cooperating in a second tongue and groove relationship with circumferentially facing edges on other of said circumferentially adjacent panels.

* * * * *

UNITED STATES PATENT AND TRADEMARK OFFICE

CERTIFICATE OF CORRECTION

PATENT NO. : 4,480,436

DATED : November 6, 1984

INVENTOR(S) : Harvey M. Maclin

It is certified that error appears in the above-identified patent and that said Letters Patent is hereby corrected as shown below:

Column 6, claim 2, line 48, after the word "and" insert --the outlet and--.

Signed and Sealed this

*Twelfth* Day of *November 1985*

[SEAL]

*Attest:*

DONALD J. QUIGG

*Attesting Officer*

*Commissioner of Patents and Trademarks*